US009935364B2

(12) United States Patent
Mellor

(10) Patent No.: US 9,935,364 B2
(45) Date of Patent: Apr. 3, 2018

(54) SINGLE-RADOME MULTI-ANTENNA ASSEMBLY

(71) Applicant: Parallel Wireless, Inc., Nashua, NH (US)

(72) Inventor: Simon Mellor, Heathfield (GB)

(73) Assignee: Parallel Wireless, Inc., Nashua, NH (US)

( * ) Notice: Subject to any disclaimer, the term of this patent is extended or adjusted under 35 U.S.C. 154(b) by 3 days.

(21) Appl. No.: 15/177,336

(22) Filed: Jun. 8, 2016

(65) Prior Publication Data

US 2016/0359224 A1 Dec. 8, 2016

Related U.S. Application Data

(60) Provisional application No. 62/172,742, filed on Jun. 8, 2015, provisional application No. 62/198,558, filed on Jul. 29, 2015.

(51) Int. Cl.

| | |
|---|---|
| ***H01Q 1/12*** | (2006.01) |
| ***H01Q 1/42*** | (2006.01) |
| ***H01Q 1/24*** | (2006.01) |
| ***H01Q 3/06*** | (2006.01) |

(Continued)

(52) U.S. Cl.

CPC ..... *H01Q 1/42* (2013.01); *H01Q 1/125* (2013.01); *H01Q 1/1228* (2013.01); *H01Q 1/246* (2013.01); *H01Q 3/06* (2013.01); *H01Q 3/08* (2013.01); *H01Q 3/12* (2013.01)

(58) Field of Classification Search

CPC ..... H01Q 1/1228; H01Q 1/246; H01Q 1/42; H01Q 1/125; H01Q 3/06; H01Q 3/08; H01Q 3/12

See application file for complete search history.

(56) References Cited

U.S. PATENT DOCUMENTS 4,185,288 A * 1/1980 Dosch ..... H01Q 1/1235 343/713

4,914,448 A * 4/1990 Otsuka ..... H01Q 1/42 343/700 MS (Continued)

OTHER PUBLICATIONS

R. H. Cary, "Avionic Radome Materials," Advisory Group for Aerospace Research and Development, Paris, France, Oct. 1974, retrieved from http://www.dtic.mil/dtic/tr/fulltext/u2/a007956.pdf.

*Primary Examiner* — Tho G Phan

(74) *Attorney, Agent, or Firm* — Michael Saji

(57) ABSTRACT

Amount for a plurality of radio antennas is disclosed. Specifically, a plurality of stacked radio antenna mounting assemblies is provided, each further comprising a top mounting plate, a mounting pole affixed to a bottom face of the top mounting plate, and a bottom mounting plate affixed at a top face to the mounting pole, and rotatably affixed to a top mounting plate of an adjoining mounting assembly. Each radio antenna mounting assembly is thereby configured to be independently rotatable in azimuth with respect to an adjoining mounting assembly. A radio-transparent radome is also provided with a height greater than a combined height of each of the plurality of radio antenna mounting points configured to slide over the plurality of radio antenna mounting assemblies to cover each of the radio antenna mounting assemblies.

19 Claims, 15 Drawing Sheets

(51) Int. Cl.
*H01Q 3/08* (2006.01)
*H01Q 3/12* (2006.01)

(56) References Cited

U.S. PATENT DOCUMENTS

| | | | | |
|---|---|---|---|---|
| 4,920,350 | A * | 4/1990 | McGuire | H01Q 1/18 343/709 |
| 5,619,215 | A * | 4/1997 | Sydor | H01Q 3/08 343/765 |
| 8,077,113 | B2 | 12/2011 | Syed et al. | |
| 2012/0154239 | A1* | 6/2012 | Bar-Sade | H01Q 1/1242 343/839 |
| 2015/0372379 | A1* | 12/2015 | Zhao | H01Q 1/246 343/841 |
| 2016/0315392 | A1* | 10/2016 | Tanabe | H01Q 15/14 |

* cited by examiner

SINGLE-RADOME MULTI-ANTENNA ASSEMBLY

CROSS-REFERENCE TO RELATED APPLICATIONS

This application claims the benefit of priority under 35 U.S.C. § 119(e) of U.S. Provisional Patent Application No. 62/172,742, filed on Jun. 8, 2015 and entitled "Single-Radome Multi-Antenna Assembly," and U.S. Provisional Patent Application No. 62/198,558, filed on Jul. 29, 2015 and entitled "Single-Radome Multi-Antenna Assembly," which are hereby incorporated by reference in their entirety for all purposes. The present application also hereby incorporates by reference U.S. Pat. No. 8,879,416, "Heterogeneous Mesh Network and a Multi-RAT Node Used Therein," filed May 8, 2013, in its entirety for all purposes.

BACKGROUND

Regulations may in some cases prohibit an excessive number of antennas visible on a roof. Additionally, it is desirable to reduce the bulk of the combined radio antenna installation, to make the antenna more unobtrusive. However, it is difficult to provide a low-profile antenna installation, particularly when each of a plurality of antennas is being used for a different purpose and/or may be required to point in a particular direction, which may be different than the directionality required for any other antenna, such as when providing a point-to-point or mesh network in which antennas are pointed directly at each other. This need will be particularly acute for dense small cell deployments in urban or rural environments, which may be required to blend into the urban landscape.

Currently, when multiple antennas are used, they are all mounted to a single mounting pole and pointed in different directions, which does not solve the problem described above.

One potential solution would be to cover several antennas with a single radome, thereby causing multiple antennas to visually appear as a single antenna. However, it is difficult to cover several antennas with a single radome (a radio-transparent shroud) that is reasonably compact while still providing the configurability needed for several antennas. For example, if two antennas are to be mounted to a mounting pole while facing in different directions, and the radome must be large enough to cover both antennas, the radius of the radome ends up being at least as great as the size of the larger antenna.

SUMMARY

In one embodiment a mount for a plurality of radio antennas is disclosed, comprising: a plurality of stacked radio antenna mounting assemblies, each further comprising: a top mounting plate, a mounting pole affixed to a bottom face of the top mounting plate, and a bottom mounting plate affixed at a top face to the mounting pole; and rotatably affixed to a top mounting plate of an adjoining mounting assembly, wherein the mounting pole is affixed to the top mounting plate and the bottom mounting plate at an edge of the top mounting plate and at an edge of the bottom mounting plate aligned with the edge of the top mounting plate so as to create a cylindrical volume, and wherein each radio antenna mounting assembly is thereby configured to be independently rotatable in azimuth with respect to an adjoining mounting assembly; and a radio-transparent radome with a height greater than a combined height of each of the plurality of radio antenna mounting assemblies, the radio-transparent radome configured to slide over the plurality of radio antenna mounting assemblies to cover each of the cylindrical volumes of the plurality of radio antenna mounting assemblies.

The plurality of radio antenna mounting assemblies may be each rotatably affixed to a top mounting plate of an adjoining mounting assembly using a bolt and nut threaded mating assembly. The mounting assemblies may each may further comprise a setback comprising a distance between matching edges of the top and bottom mounting plates and the mounting pole of each of the plurality of radio antenna mounting assemblies, the setback configured to enable tilt angle adjustment of antennas coupled to the mounting pole within the cylindrical volume of the each radio antenna mounting assembly. The mount may further comprise a mounting bracket with screw holes for mounting a radio frequency antenna, the mounting bracket coupled to the mounting pole of each of the plurality of radio antenna mounting assemblies, the mounting bracket configured to permit tilt angle adjustment of a radio frequency antenna mounted within the cylindrical volume independent of an angle of any other antenna in the plurality of radio antenna mounting assemblies. The mount may further comprise a mounting bracket configured to permit tilt angle adjustment of a radio frequency antenna mounted within the cylindrical volume, and a tilt angle adjustment angle guide colocated with the mounting bracket. The mount may further comprise a second rotatable mounting point adjacent to the mounting pole and coupled to the top mounting plate or the bottom mounting plate of a mounting assembly, the second rotatable mounting point configured to permit azimuth rotation of an antenna mounted outside of the cylindrical volume. The top and the bottom mounting plates may further comprise a plurality of cutouts for threading radio frequency cables. The mount may further comprise an angle guide between the bottom mounting plate and the top mounting plate of the adjoining mounting assembly having marks to aid in adjusting the orientation of the mounting assembly and the adjoining mounting assembly, and a cutout in the bottom mounting plate and the top mounting plate of the adjoining mounting assembly showing a visible portion of the angle guide.

The mount may further comprise a grounding wire passing through holes in adjoining top and bottom mounting plates for providing grounding of antennas in separate mounting assembly volumes. The radio-transparent radome may be cylindrical on one side and flat on another side so as to slide over the plurality of radio antenna mounting assemblies and also over a panel antenna attached to a side of a radio antenna mounting assembly exterior to an internal volume of the radio mounting assembly. Each radio antenna mounting assembly may be configured to be independently rotatable without any portion of any antenna mounted within each radio antenna mounting assembly protruding outside of a cylindrical volume of the each radio antenna mounting assembly. The mount may further comprise a motor for rotating an azimuth angle of a radio antenna mounting assembly. The mount may further comprise a motor for rotating a tilt angle of a radio antenna at a setback mounted within a radio antenna mounting assembly. The mount may further comprise a topmost plate, the topmost plate being rotatably attached to a top plate of a radio antenna mounting assembly, the topmost plate further comprising mount points for a global positioning system (GPS) antenna and an omni-directional antenna. A mounting pole may be hollow and used for radio frequency cable routing. The mount may further comprise a 3G antenna, a Long Term Evolution (LTE) antenna, and a global positioning system (GPS) antenna, or a plurality of Long Term Evolution (LTE) antennas.

DETAILED DESCRIPTION

Figure 1:
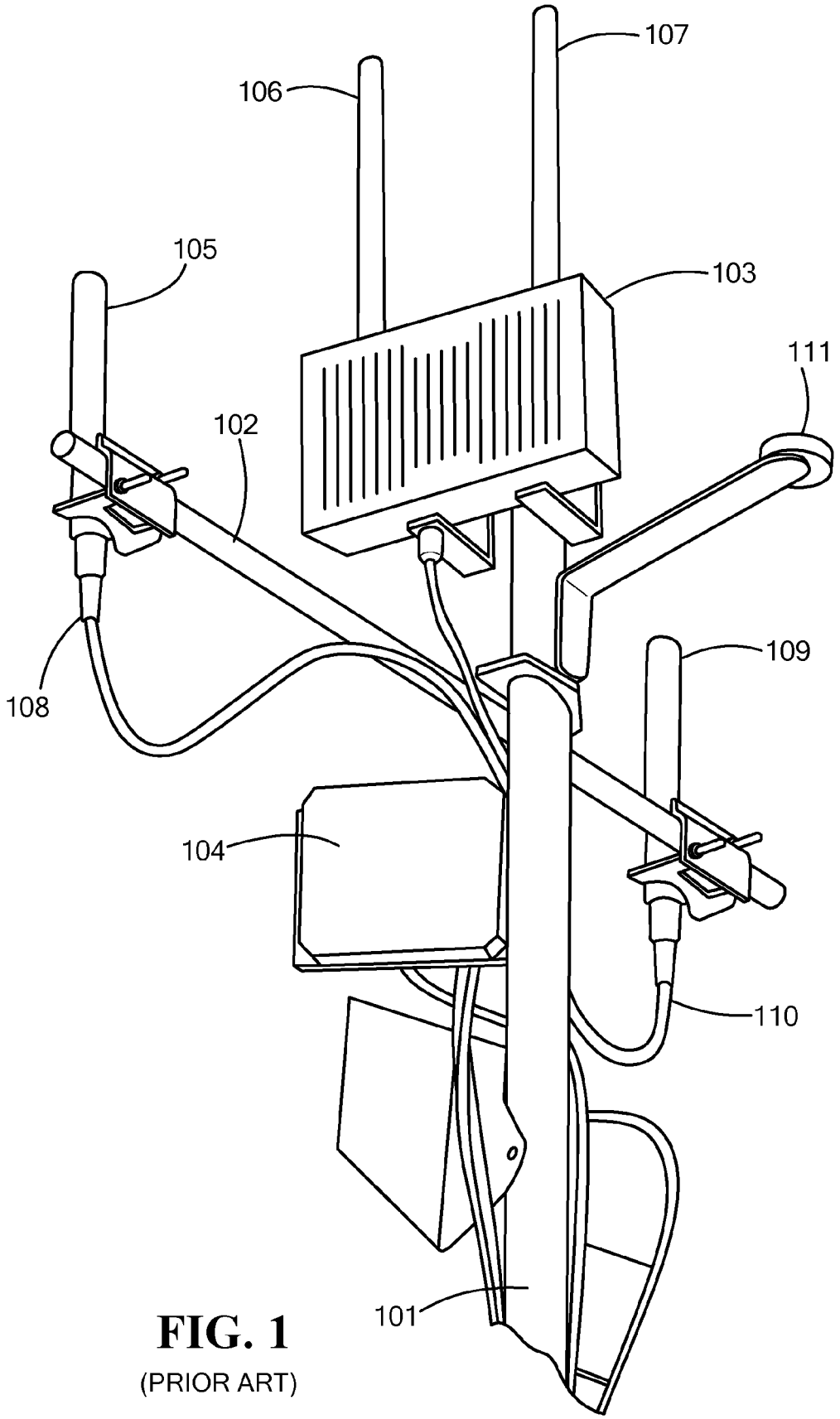
FIG. 1 (PRIOR ART)
FIG. 1 is a schematic drawing of a prior art cellular radio mast.

A solution is disclosed that enables multiple antennas to share a single mount point while being able to be covered by a radome of significantly reduced size relative to the prior art.

Multiple antennas may be physically connected to each other, and mounted with a single attach point or several attach points. Each antenna may have its own rotational axis that is geometrically separate from the axes of the other connected antennas and in some cases also separate from the axis of the mast being used to mount the combined antenna assembly, enabling each antenna to have its own rotational adjustability of up to 360 degrees azimuth. Each antenna may also have its own tilt angle adjustment separate from that of the other connected antennas, of at least +/−8 degrees of tilt angle adjustment. The complete assembly may be covered with a single radome, which may be a circular radome. The assembly may be mountable from the base or from both ends. The antennas may be mesh antennas, in-band backhaul antennas, access antennas, 3G antennas, 4G antennas, 5G antennas, or any other type of antenna, in any combination. A 5 GHz mesh antenna and a Long Term Evolution (LTE) antenna for access are contemplated, including an LTE band 3 high-gain narrowband LTE access antenna.

Independent rotatability of azimuth of each antenna can be achieved by separation of each antenna into an antenna assembly in a stacked series of antenna assemblies. The stacked assemblies may rotate around each other using a fixture, such as a bolt and a nut, as the fixed point or axis of rotation. Each stacked assembly is coupled to the assemblies above and below it using this rotational fixture. The rotational fixture can, in some embodiments, be placed in the geometric center of a circular assembly, such that all of the assemblies can be rotated to an arbitrary position without preventing a radome from sliding over all the coupled assemblies.

To provide rotatability in the up/down or tilt direction, enabling each antenna to be pointed up or down as needed independently of the other antennas, the antenna may be connected using a standard up/down adjustable angle mount. The angle mount may be trapezoidal or triangular and may be coupled at its flat base to an attachment pole or tube that perpendicularly connects the top and bottom plates of the antenna assembly, which serves as the pivot point for the up/down angle adjustment. However, the attachment pole or tube may be located at any portion of the antenna assembly. Viewed from the top down, the attachment tube may be connected at a location within the interior of the circumference of the top/bottom plates of the assembly, or at the edge of the circumference of the top/bottom plates, or at another location.

As shown in the figures accompanying this disclosure, multiple antennas are configured to be independently aligned or oriented by use of a setback mount. The axis of the setback mount is separate from the axis of the mount itself. As the setback mount allows the overall center of each individual antenna assembly, even when tilted or angled, to be brought closer to the center of the mounting mast, the overall profile of the multi-antenna assembly is reduced and the radius of the radome is reduced as well. Any downtilt brackets or other brackets or mounting hardware may be attached to the assembly such that the brackets and the antennas attached thereto remain within a volume of the setback portion of the mount. Multiple antenna sections may be connected to each other, and may rotate independently of each other. In some embodiments the rotatability may be reduced and/or fixed after installation by the use of screws or other mounting hardware.

In some embodiments, a GPS antenna may be enabled to be placed at the top of the antenna assembly such that it has unobstructed visibility of the sky. In some embodiments, mesh antennas and in-band backhaul antennas may be provided with 360 degrees azimuth and +/−8 degrees tilt angle adjustability, while access antennas may be provided with 360 degree azimuth adjustability. In some embodiments, the complete assembly may be covered by a single circular radome to simulate a single antenna assembly.

In some embodiments, an antenna for a mesh network may be provided according to this disclosure. A first setback may be provided to permit a first mesh antenna to be rotated to point towards a mesh node. A second setback may be provided, which may be used for a second mesh antenna, or for an access antenna, or for another antenna; this second setback may be independently rotatable/orientable from the first setback. This enables the first mesh antenna to be rotated in a different direction than the second antenna, which is often required as a result of the varied physical placement of mesh nodes in a deployment environment.

In some embodiments, a mounting plate design may be integrated into the antenna assembly. The bottom portion of each antenna may be fixed to a mounting plate, while the back of each antenna may be fixed to a mounting assembly at the rear of an individual setback. As the mounting assembly may support the weight of the antenna, in some embodiments the mounting plate need not support the weight of the antenna. However, the mounting plate may enable additional stability in high winds. Additionally, in some embodiments, bottom and top mounting plates may be separated and articulated, such that each antenna setback may be independently rotated. The bottom and top mounting plates may be circular or square in shape, may have grooves or slots for screws used for securing the plates, and may have holes for securing the antennas thereto.

In some embodiments, an antenna may be mounted on a rear side of a setback. Each setback has a front and a rear side, the rear side being the side where a mast portion is located. As the antenna in the setback points toward the front side, an antenna on the rear side may be pointed in the opposite direction without interference. A larger antenna may be supported on the rear side mast, including one that is too large to fit in a single setback. For example, the rear sides of two setbacks may be used to provide a mounting mast for a larger antenna. A hinged mounting bracket may be provided for coupling the larger antenna and the setback rear side mast.

As another example, a second attachment pole may be introduced perpendicular to the top and bottom plates of a particular antenna assembly. The first attachment pole may be used to attach a first antenna within the volume of the antenna assembly. The second attachment pole may be positioned at the edge of the circumference of the antenna assembly. The second attachment pole may be coupled to the antenna assembly at the top plate and the bottom plate, and may be placed in a socket wherein the second attachment pole is enabled to rotate, either freely or in a secured fashion (i.e., able to be secured at a particular angle).

A large panel antenna may be coupled to the second attachment pole, the panel antenna sitting outside of the cylindrical volume of the antenna assembly, pointing outward from the mast but potentially overlapping other antenna assemblies. When overlap may exist with the facing direction of one or more additional antennas, causing the large panel antenna to cover the beam of another antenna, the other antennas may be rotated to not be in the shadow of the large panel antenna.

In some embodiments, three or any other number of different antennas may be stacked on top of each other, each with its own setback and mounting plate, such that the antennas can be used to provide multiple sectors of access coverage from the same mast, while being orientable and rotatable to provide good performance for different emplacements.

FIG. 1 is a schematic drawing of a prior art cellular radio mast. The prior art mast is an example of a typical cellular mast in use today. Small cell base station 103 is attached at the top of pole 101, which is on a mast, and has omnidirectional antennas 106 and 107. Crossbar 102 is used to mount additional omnidirectional antennas 105 and 109, which are coupled via unsightly radio frequency (RF) cables 108 and 110. Another antenna 104, which may be a Wi-Fi or mesh backhaul antenna, is attached directly to pole 101. Another crossbar is used to mount a GPS antenna 111. As shown, there are six visible antennas on the pole, making it difficult for such a mast to comply with local building codes regarding aesthetics. More antennas would require even more complex configurations of crossbars.

Figure 2:
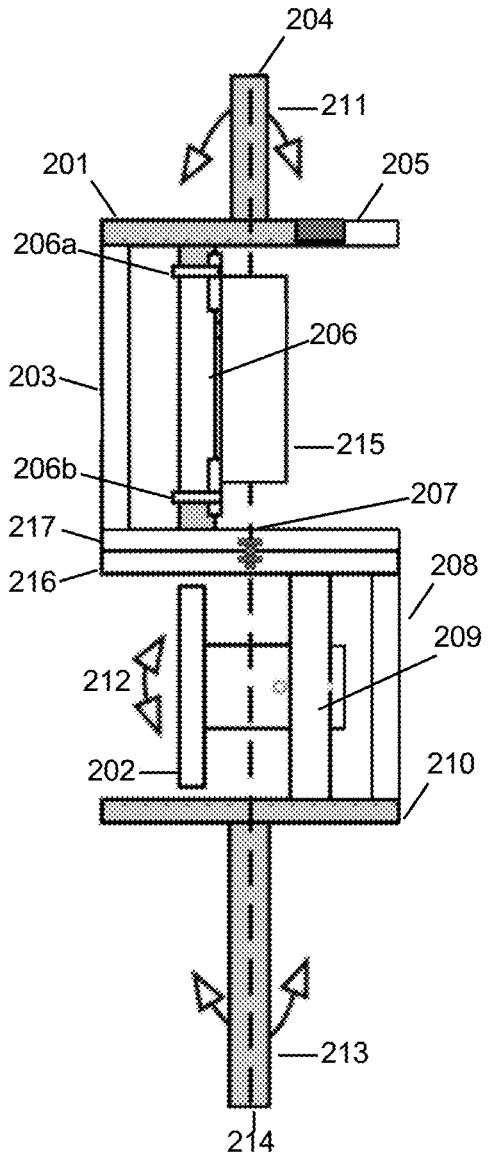
FIG. 2 is a schematic cross-sectional drawing of a radio mast, in accordance with some embodiments.

FIG. 2 is a schematic cross-sectional drawing of a radio mast, in accordance with some embodiments. Broadly speaking, a first and a second antenna module are placed atop a base. The antenna modules are rotatable with respect to each other. Any number of modules may be stacked, as the physical weight of the antennas plus any wind loading or other stress factors should be easily handled by the attachment fixture between each of the modules.

A first antenna module is shown, including top plate 201, structural back plate 203, bottom plate 217, and attachment pole 206, which are welded together. An antenna 215 is attached to attachment pole 206 via clamps **206*a* and 206*b*. The entire assembly is rotatable along the vertical axis of the mast, as defined by the dotted line through top pole 204 and bottom pole 214; however, the top and bottom are not physically connected except through adjustable fixing 207, which is a combination of nuts and bolts that can be easily disassembled or assembled, or loosened to adjust the rotational angle. Arrows 211 and 213 reflect the fact that the modules can be rotated with respect to each other or with respect to the fixed orientation of the mast, in any direction (360 degrees). The top of the antenna module, here, top plate 201, is a desirable location for GPS receiver 205**, to enable it to have a clear view of the sky.

A second antenna module is connected to the first antenna module via fixing 207. The second antenna module includes top plate 216, structural back plate 208, attachment pole 209, and bottom plate 210, which are welded together. Second antenna 202 is connected to attachment pole 208 via a bracket that permits angling 212 of the antenna up and down.

The second antenna 216 may be a mesh network antenna. The first antenna 215 may be a 3G or 4G antenna. The first antenna may be enabled to rotate 360 degrees in azimuth. The second antenna 216 may be able to be angled plus or minus roughly 8 degrees up or down using an adjustable bracket within the second antenna module, and 360 degrees in azimuth. The two sections rotate independently. Once aligned, the fixing between the two sections is tightened and the two sections are secured together. No crossbars are provided, as different antennas are enabled to be placed at different heights within the antenna stack. The entire assembly is to be covered by a radome (not shown).

Figure 3:
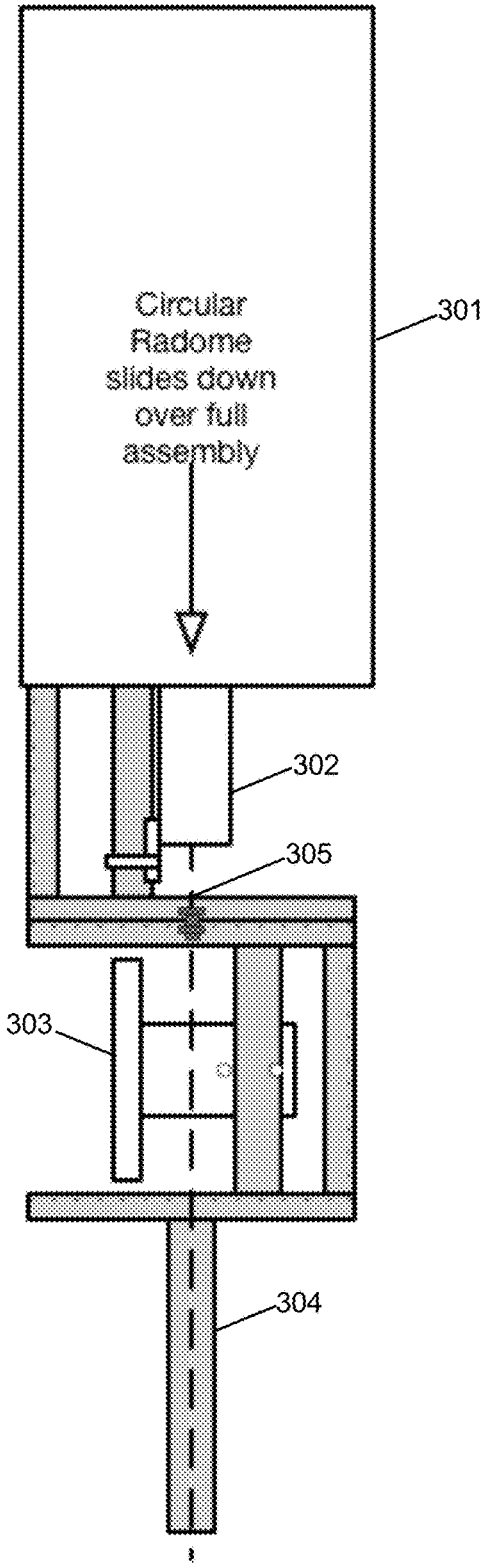
FIG. 3 is a schematic cross-sectional drawing of a radio mast shown with radome, in accordance with some embodiments.

FIG. 3 is a schematic cross-sectional drawing of a radio mast shown with radome, in accordance with some embodiments. Radome 301 is shown in a side view, partially separated from the mast and antenna assembly. Antenna 302 is a 3G or 4G antenna, shown in a side view. Antenna 303 is a mesh antenna, shown in a side view. Pole 304 is a metal pole at the bottom of the antenna assembly. Pole 304 may be affixed to a radio mounting mast, or may be mounted to a mast, in some embodiments.

Assembly 305 is a bottom of a first antenna section in which antenna 302 is mounted, and a top of a second antenna section in which antenna 303 is mounted, coupled together by a bolt and threaded nut assembly. The bolt and threaded nut assembly is in the geometric center of the assembly and permits rotation of first and second antenna sections in relation to each other. The rotational axis of the first and second antenna sections is shown as a dotted line, and is the same axis as pole 304, roughly enabling the antenna sections to have their center of mass over pole 304.

Radome 301 is configured with at least one hollow bottom end, the hollow bottom end enabling the radome to be placed over the antenna mast assembly after the antennas are affixed to the antenna mast assembly. Sliding the radome over the antenna assembly may be performed while the antenna mast assembly is on the ground, in some embodiments. In other embodiments, the radome may be taken off or replaced while the assembly is mounted to its mast. Radome 301 is affixed as described with relation to the following figure.

Figure 4:
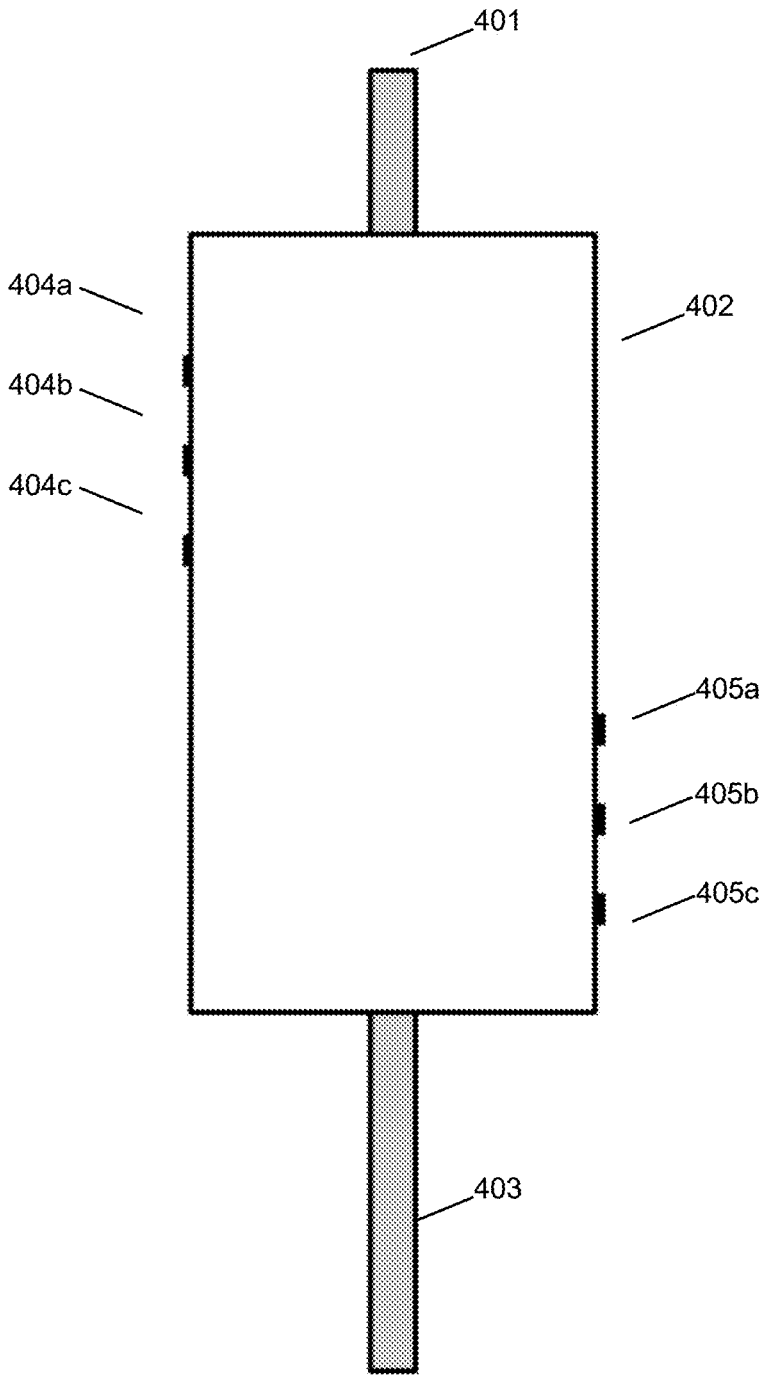
FIG. 4 is a schematic cross-sectional drawing of a radio mast with affixed radome, in accordance with some embodiments.

FIG. 4 is a schematic cross-sectional drawing of a radio mast with affixed radome, in accordance with some embodiments. Once the radome is installed by sliding over the antenna sections, radome 402 covers all antenna sections, in effect causing them to appear as a single antenna section, which enables the antenna to more readily comply with aesthetics regulations. Pole 401 and pole 403 protrude from the radome 402 and may be used for mounting. In some embodiments, if mounting is performed using one of the poles but not the other, only one pole may be provided. Fixing screws 404*a*, 404*b*, 404*c* may be aligned along a vertical axis and may couple to an attachment pole within the hidden volume of a particular antenna assembly, such as an attachment pole that is located at the circumference of an antenna assembly, as described elsewhere herein. More or fewer screws may be used, or other types of screws, bolts, or fixtures. Longer fixing screws may be used if the attachment pole is not located at the edge of the antenna assembly.

Additional fixing screws 405*a*, 405*b*, 405*c* are also provided. These fixing screws may couple to another attachment pole within another volume of another antenna assembly. Since fixing screws 404*a*, 404*b*, 404*c* and 405*a*, 405*b*, 405*c* are coupled to different antenna assemblies, which are independently rotatable, the fixing screws may fix the rotation of the antenna assemblies. Additional fixing screws may be used to fix one or more, or all, of the independent antenna assemblies. If two or more sets of fixing screws are used, the fixing screws will securely fasten the radome to the stacked antenna assemblies. In some embodiments, the height of a radome that encompasses two antenna assemblies may be 51 cm. In some embodiments, the diameter of a radome that encompasses the entire stack of antenna assemblies may be 27 cm.

Figure 5A:
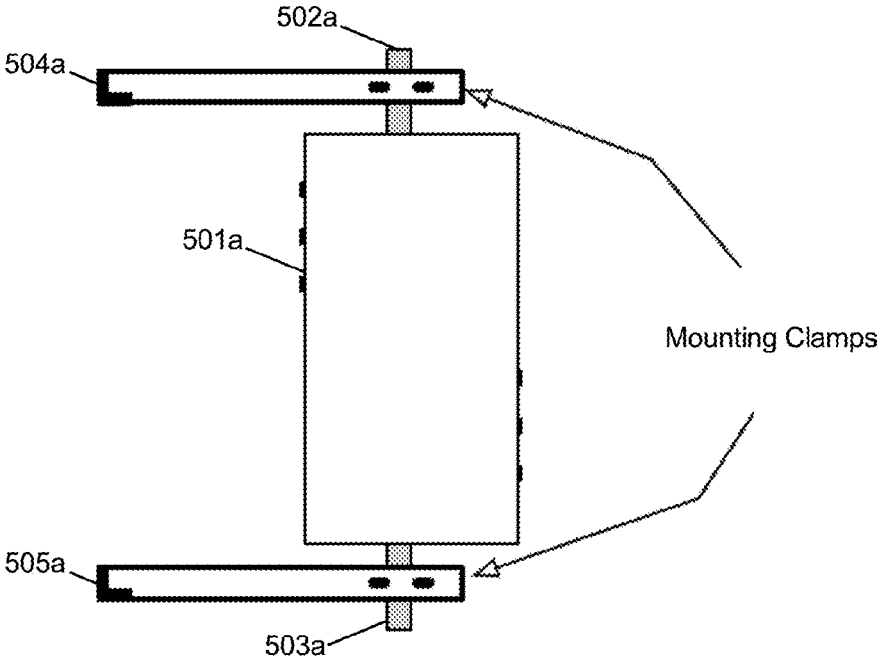
FIGS. 5A and 5B are schematic cross-sectional drawings of radio mast mounting apparatuses, in accordance with some embodiments.
Figure 5B:
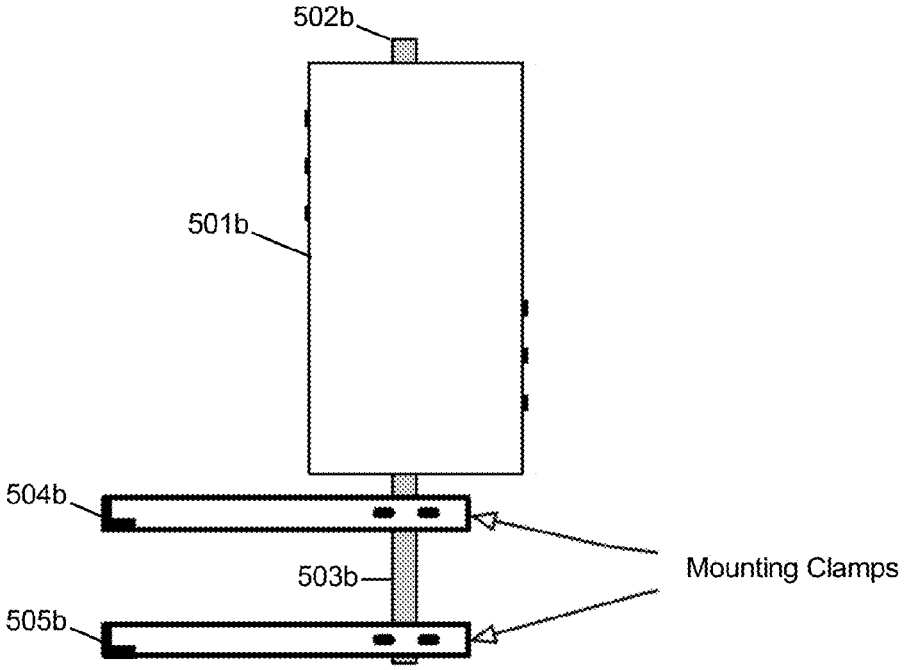

FIGS. 5A and 5B are schematic cross-sectional drawings of radio mast mounting apparatuses, in accordance with some embodiments. FIG. 5A shows mounting of a radio mast assembly using a top mounting pole and a second mounting pole. Radome 501*a* is shown with two sets of fixing screws as described above with respect to FIG. 4. Top mounting pole 502*a* protrudes from the top of radome 501*a*, and is clamped to a fixed structure 504*a* at a first point. Bottom mounting pole 503*a* protrudes from the bottom of radome 501*a*, and is clamped to a fixed structure 505*a* at a second point. Fixed structures 504*a* and 505*a* may be the same structure, or a different structure; and may be struts or beams or poles or other fixtures connected to a cell tower, monopole, or a building; and may be clamped to mounting poles 502*a* and 503*a* using standard clamps.

Similarly, FIG. 5*b* shows mounting of a radio mast assembly using a bottom mounting pole only, and dual clamps at the base. Radome 501*b* is shown with two sets of fixing screws as described above with respect to FIG. 4. Top mounting pole 502*b* protrudes from the top of radome 501*a*, but is not used for mounting. Bottom mounting pole 503*b* protrudes from the bottom of radome 501*a*, and is clamped to a fixed structure 504*b* at a first point and to a fixed structure 505*b* at a second point. Fixed structures 504*b* and 505*b* may be the same structure, or a different structure; and may be struts or beams or poles or other fixtures connected to a cell tower, monopole, or a building; and may be clamped to mounting poles 502*b* and 503*b* using standard clamps.

Figure 6A:
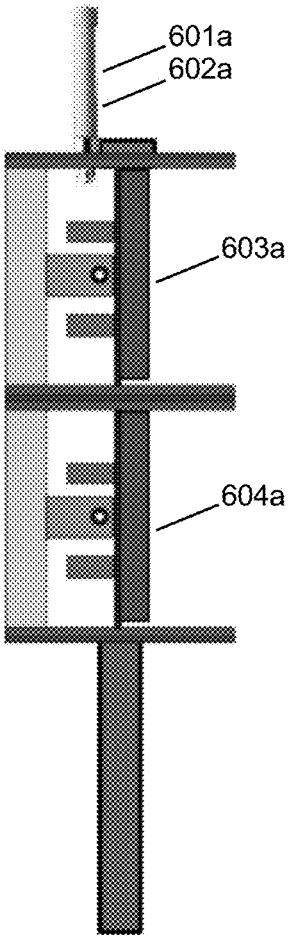
FIGS. 6A and 6B are schematic profile and front cross-sectional views of a radio mast, in accordance with some embodiments.
Figure 6B:
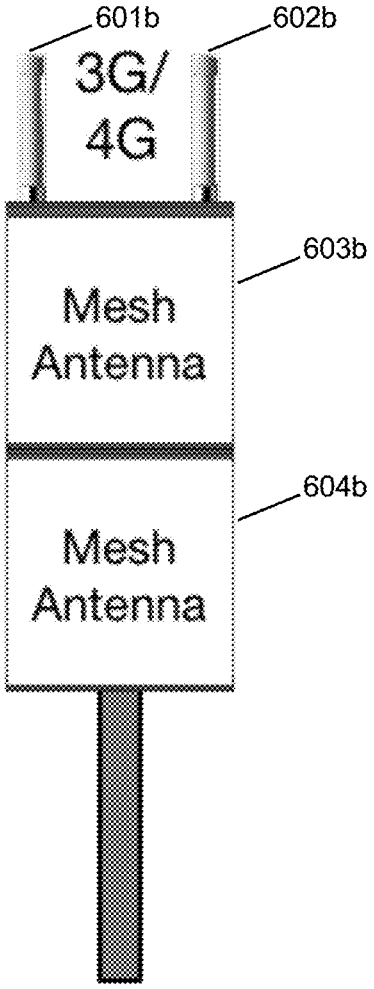

FIGS. 6A and 6B are schematic profile and front cross-sectional views of a radio mast, in accordance with some embodiments. FIG. 6A is a schematic profile view. Antennas 601*a*, 602*a* are two omnidirectional antennas, only one of which is visible from the angle shown, affixed to the top of the antenna stack. The omnidirectional antennas may be connected to 3G or 4G baseband radios further down in the antenna stack or colocated at the base of the antenna stack. Antenna 603*a* is a first antenna for a mesh network radio used to form a mesh network. Antenna 604*a* is a second antenna for a mesh network radio. Antennas 603*a* and 604*a* are mounted to attachment poles that are located at the back of their respective antenna assemblies (i.e., setbacks), and which may be rotated to be oriented in different directions than each other, although they are shown pointing in the same direction. FIG. 6B is a front view. Antennas 601*b*, 602*b* correspond to antennas 601*a*, 602*a*. Antennas 603*b*, 604*b* correspond to antennas 603*a*, 604*a*. Unlike in FIG. 2, no structural back wall is shown, as the attachment poles are sufficient to give structure to the assemblies.

Figure 7A:
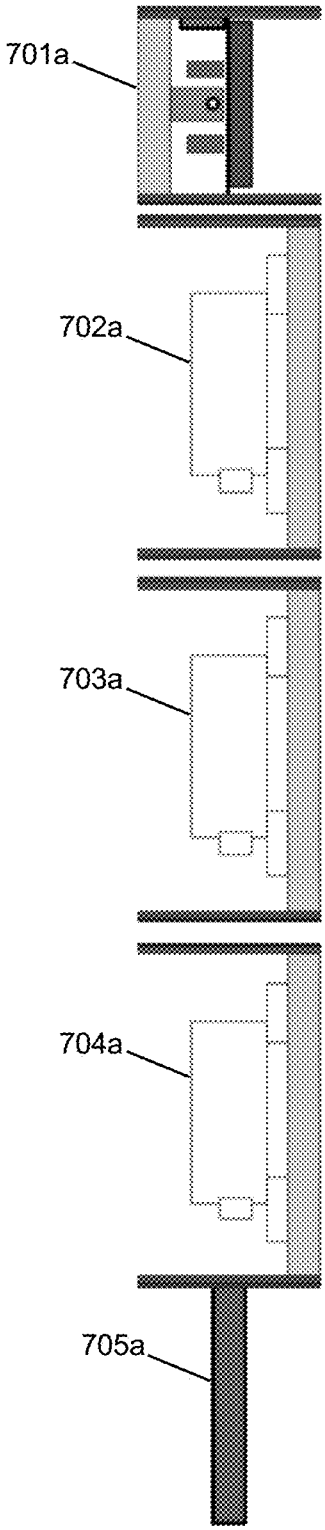
FIGS. 7A and 7B are schematic profile and front cross-sectional views of another radio mast, in accordance with some embodiments.
Figure 7B:
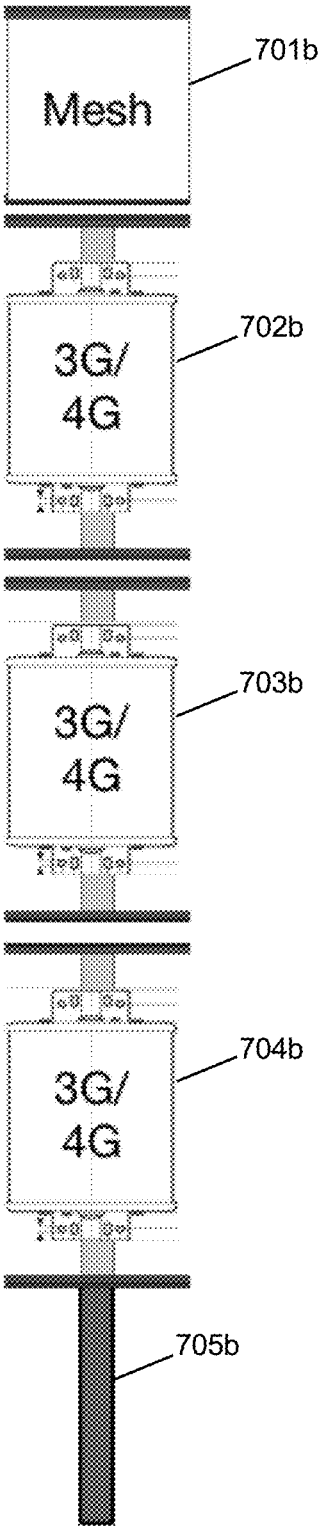

FIGS. 7A and 7B are schematic profile and front cross-sectional views of another radio mast, in accordance with some embodiments. FIG. 7A is a profile view. FIG. 7B is a front view. Mesh antenna module 701*a*/701*b* is shown with a mesh antenna mounted to an attachment pole set back from the center of rotation of the overall mast, visible in profile in FIG. 7A. The attachment pole is attached perpendicularly between a top plate and a bottom plate of the mesh antenna module 701*a*/701*b*. The mesh antenna is mounted to the attachment pole using a bracket that is capable of being angled, to permit adjustment of the up/down direction of the mesh antenna. The mesh antenna may be flat and may be large enough to fit appropriately in mesh antenna module 701*a*, as shown by the front view of mesh antenna module 701*b* in FIG. 7B; in some embodiments the size of mesh antenna module 701*a* may be determined by what size and volume are required for the mesh antenna module. The mesh antenna is not rotatable as shown within the volume of mesh antenna module 701*a*, in some embodiments. However, the whole of mesh antenna module 701*a* may be rotatable. As shown, mesh antenna module 701*a*/701*b* is not physically touching any other antenna module; assembly of the antenna modules with each other may involve securing each module to its physically adjacent module using a bolt and nut assembly or other assembly, and may also involve setting the appropriate azimuth rotation prior to tightening. Adjustment may be possible in some embodiments by loosening the bolt and nut and readjusting the rotation angle.

3G/4G antenna modules 702*a*/702*b*, 703*a*/703*b*, and 704*a*/704*b* are similar to each other and are pointed in the same direction as each other, but perpendicularly from mesh antenna module 701*a*/701*b*. The antennas may be connected to different radio heads, different radio baseband units, or the same radios or baseband units. The antennas may be connected to an attachment pole, as with mesh antenna module 701*a*, positioned in a setback and providing significant volume for the physical volume of the antenna. As shown, antennas 702, 703, 704 are mounted against a flat bracket, but could be mounted using an angled bracket or using an adjustable bracket allowing for positioning to accommodate up/down angle changes. The antennas may be for different 3G or 4G bands, or they could be for the same band but oriented in a different direction, i.e., for sectorized coverage. The antenna assemblies may be rotatable until fastened together with bolts at the rotational center point directly above the mast, as described herein. The antenna assemblies may be provided separate from each other and assembled into a single assembly.

Mast 705*a*/705*b* may be built into antenna module 704*a*/704*b*, or may be screwed on separately. Mast 705*a*/705*b* may be used to secure the entire assembly to a fixed object, such as a building, or may be the mast itself. Additional brackets may be used to provide greater physical security. Any and all masts and poles described herein may be hollow and may permit routing of RF cables through any such hollow cavity, for ease in cable routing, such that the base of antenna module 704*a*/704*b* may include a hole in the center through which RF cables may be threaded.

Figure 8:
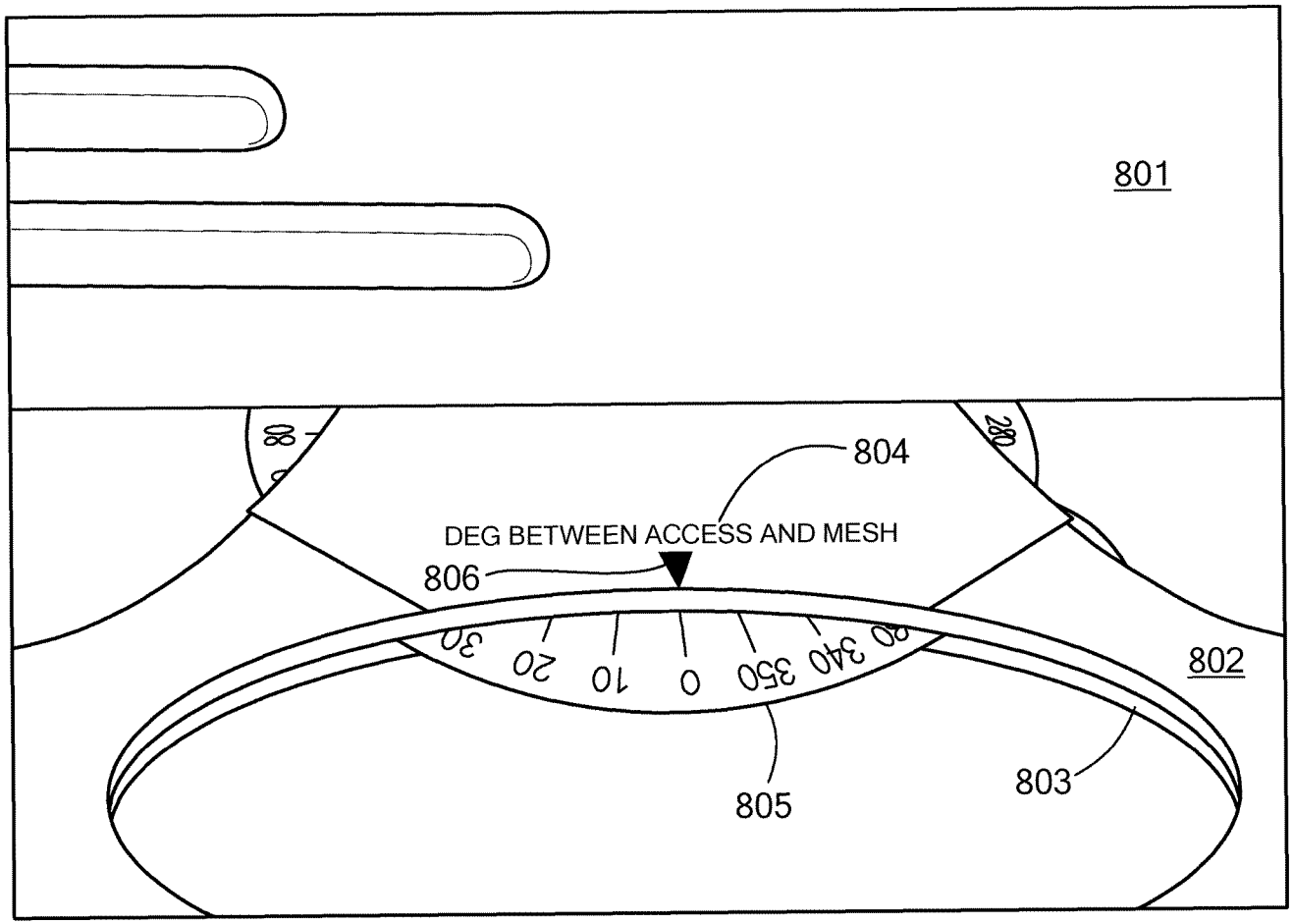
FIG. 8 is a schematic drawing of a degree adjustment stencil on a radio mast, in accordance with some embodiments.

FIG. 8 is a schematic drawing of a degree adjustment stencil on a radio mast, in accordance with some embodiments. As the antenna mounting assemblies are readily rotatable and separatable from each other, it is possible to introduce functional elements, such as shown in FIG. 8, that aid in the installation, rotation, and assembly of these components. FIG. 8 shows antenna 801 in close up, which is part of and mounted to an antenna module as described herein. Plate 802 is a bottom plate of the antenna module of antenna 801. Plate 802 includes several large oval holes, shaped to permit threading of RF cables and other cables, as well as a smaller hole for the bolt and nut fixture holding plate 802 to the top plate of the adjacent antenna module below. Plate 803 is the top plate of the adjacent antenna module below. Label 804 is a legend on plate 802. Stencil dial 805 is a guide sandwiched between plates 802 and 803 that is fixed relative to plate 803 and does not move. Arrow 806 is a marking used in conjunction with stencil dial 805. When the antenna module of antenna 801 is rotated, since plate 803 and stencil dial 805 do not move, marking 806 moves with plate 802 and points to an angle measurement corresponding to the angle difference in rotation between the antenna module of plate 802 and the antenna module of plate 803.

Figure 9:
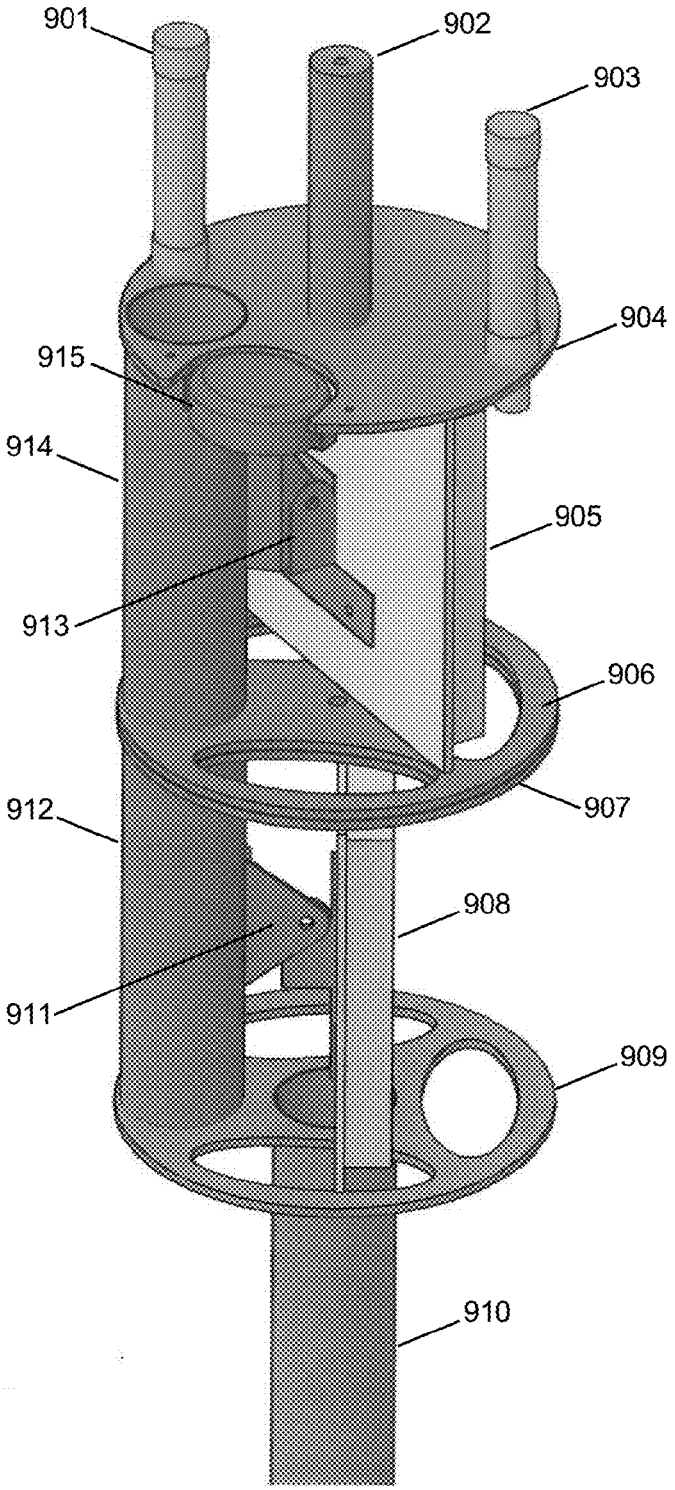
FIG. 9 is a schematic perspective drawing of a radio mast, in accordance with some embodiments.

FIG. 9 is a schematic perspective drawing of a radio mast, in accordance with some embodiments. Various components appear in FIG. 9 that are described in greater detail elsewhere herein. Antennas 901 and 903 are omnidirectional antennas at the top of the entire stacked antenna assembly. Pole 902 is a mounting pole. Plate 904 is the top plate of the top antenna module, to which antennas 902 and 903 are fastened and to which pole 902 is welded or otherwise fastened. On the underside of plate 904, RF cables link omnidirectional antennas 901 and 903 to RF sources.

Antenna 905 is the antenna located in the first antenna module directly under the omnidirectional antennas, and may be a mesh antenna, a 3G or 4G antenna, or another antenna. Antenna 905 is physically mounted to mount 913, which is connected to attachment pole 914. Attachment pole 914 is hollow, as shown by the hole where it meets plate 904. Attachment pole 914 is physically connected, and in some embodiments welded to, plates 904 and 906, but not to anything below plate 906. Mount 913 permits angling antenna 905 up or down as required by the network operator. Plate 906 is the bottom plate of the antenna module, and is affixed to attachment pole 914 but rotatably attached to plate 907, such that it may be removed and/or rotated, in some embodiments without removal, for example using a bolt and nut assembly. The hole for the bolt and nut assembly is shown in FIG. 9 but no bolt and nut assembly is shown.

Plate 907 marks the top plate of the second antenna module, stacked beneath the first antenna module. The second antenna module also includes attachment pole 912 and plate 909. The second antenna module is rotatably attached to the first antenna module. Antenna 908 is mounted to mount 911, which permits tilting up and down, and which is attached to attachment pole 912. Attachment pole 912 is connected to plates 907 and 909. Plates 906, 907, and 909 are shown as having a structure with several large ellipsoid holes in three quadrants of the plates that can be used to thread, e.g., RF cables. Plates 906, 907, and 909 are also shown as having a fourth quadrant without a large hole, to which the attachment poles can be securely affixed.

Pole 910, which may be a mast itself or which may be used to attach the assembly to a larger mast or tower, is securely affixed to plate 909. As shown, pole 910 is hollow and may be used as a conduit for cabling, with an opening within the volume of the second antenna module behind antenna 908, which will be located within the volume of the radome when the radome is affixed. The use of these hollow channels permits the antennas to be connected to baseband and radio without requiring unsightly cables to be visible on the outside of the antenna assembly.

Figure 10A:
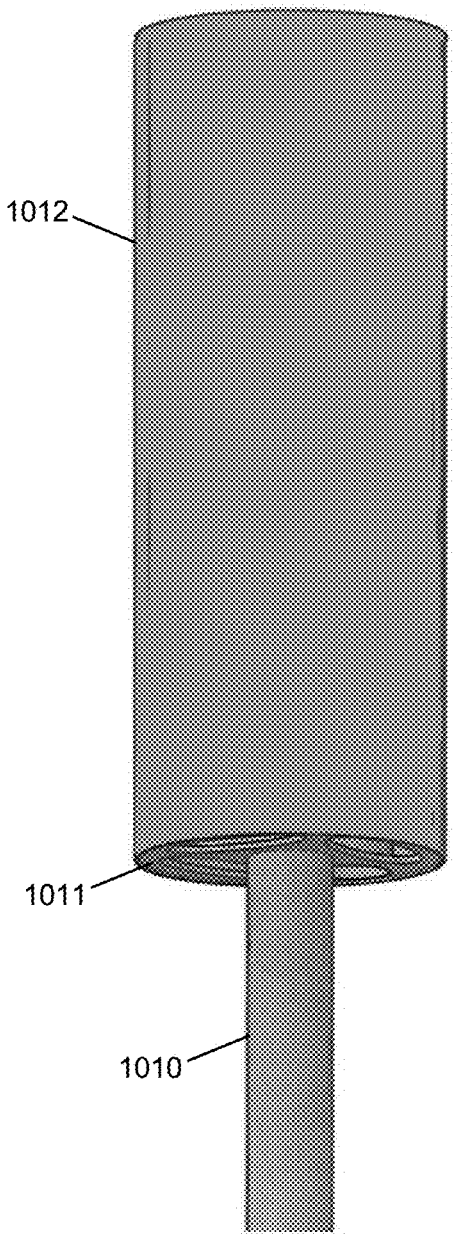
FIG. 10A is a schematic drawing of a radio mast with radome, in accordance with some embodiments.
Figure 10B:
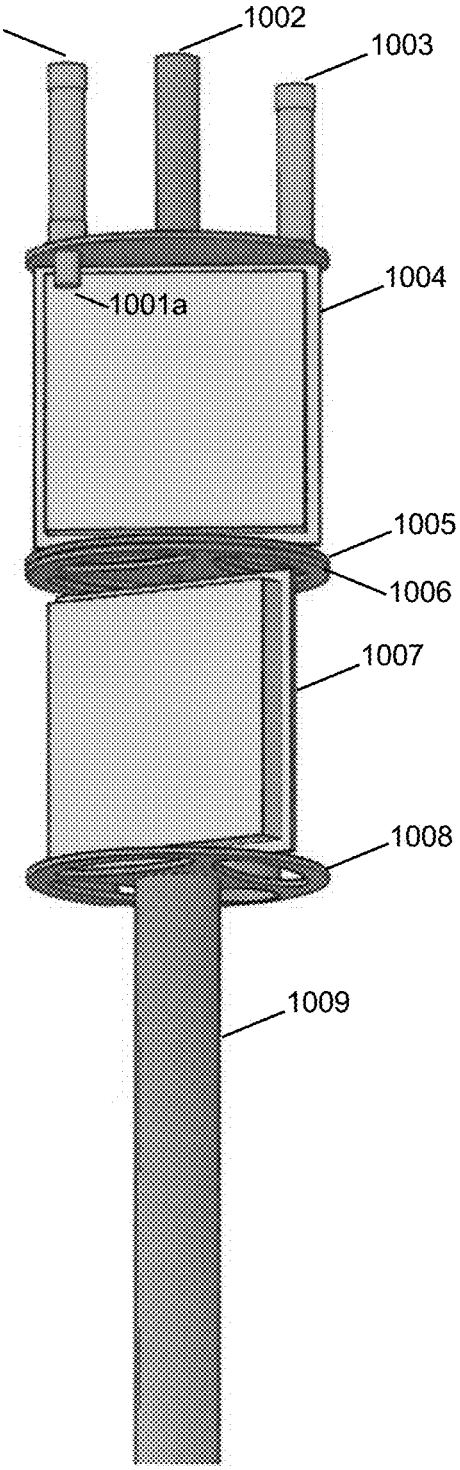
FIG. 10B is a further schematic drawing of a radio mast, in accordance with some embodiments.

FIG. 10A is a schematic drawing of a radio mast with radome, in accordance with some embodiments. FIG. 10A depicts a completed antenna assembly with radome; FIG. 10B depicts the same antenna assembly without radome. Radome 1012 completely conceals all antennas. It has a rounded, cylindrical shape, which minimizes wind loading, particularly when compared to the flat, rectangular shapes of typical RF antennas and when compared to multiple disparate antennas. Radome 1012 may be made of any radio-transparent material, such as: plastic; polypropylene or polyethylene; fabric; polymer-impregnated fabric; fiberglass; or another appropriate material. The radome may also be colored or patterned to fit in aesthetically into its environment. In some embodiments radome 1012 may be constructed of a rigid material, or in other embodiments a less rigid, flexible material. The radome may be a shroud, in some embodiments. Plate 1011 is visible below, having the characteristic shape described elsewhere herein. Mast 1010 may be the mast for the antenna assembly or may be used to affix the antenna assembly to a mast. In some embodiments the bottom of the radome may extend down in a triangular fashion, either on one side or on all sides, i.e., tapering down into a cone terminating at the mast, providing improved rigidity, wind characteristics, and appearance. In some embodiments the top of the radome may have a rounded cap shape to provide improved wind and appearance characteristics.

FIG. 10B is a further schematic drawing of a radio mast, in accordance with some embodiments. When radome 1012 is removed, it is revealed that a number of antennas are present within the radome. Omnidirectional antennas 1001 and 1003 are located at the top of the antenna assembly, along with mounting pole 1002. In some embodiments, more or fewer antennas may be provided at the top of the antenna assembly. In some embodiments, omnidirectional antennas may be provided at the bottom of the antenna assembly. RF input 1001*a* is shown for providing RF input to antenna 1001. Continuing down to the first antenna module, 3G/4G antenna 1004 is shown with a first angle, and continuing down to the second antenna module, 3G/4G antenna 1007 is shown with a second, different angle. The first and second antenna modules are connected between plates 1005 and 1006. Plate 1008 marks the bottom boundary of the antenna assembly, corresponding to plate 1011 in FIG. 10A. Plate 1008 sits atop pole 1009. RF cabling is not shown but is intended to pass through the holes visible in the plates and the hollow mast or pole 1009.

Figure 11:
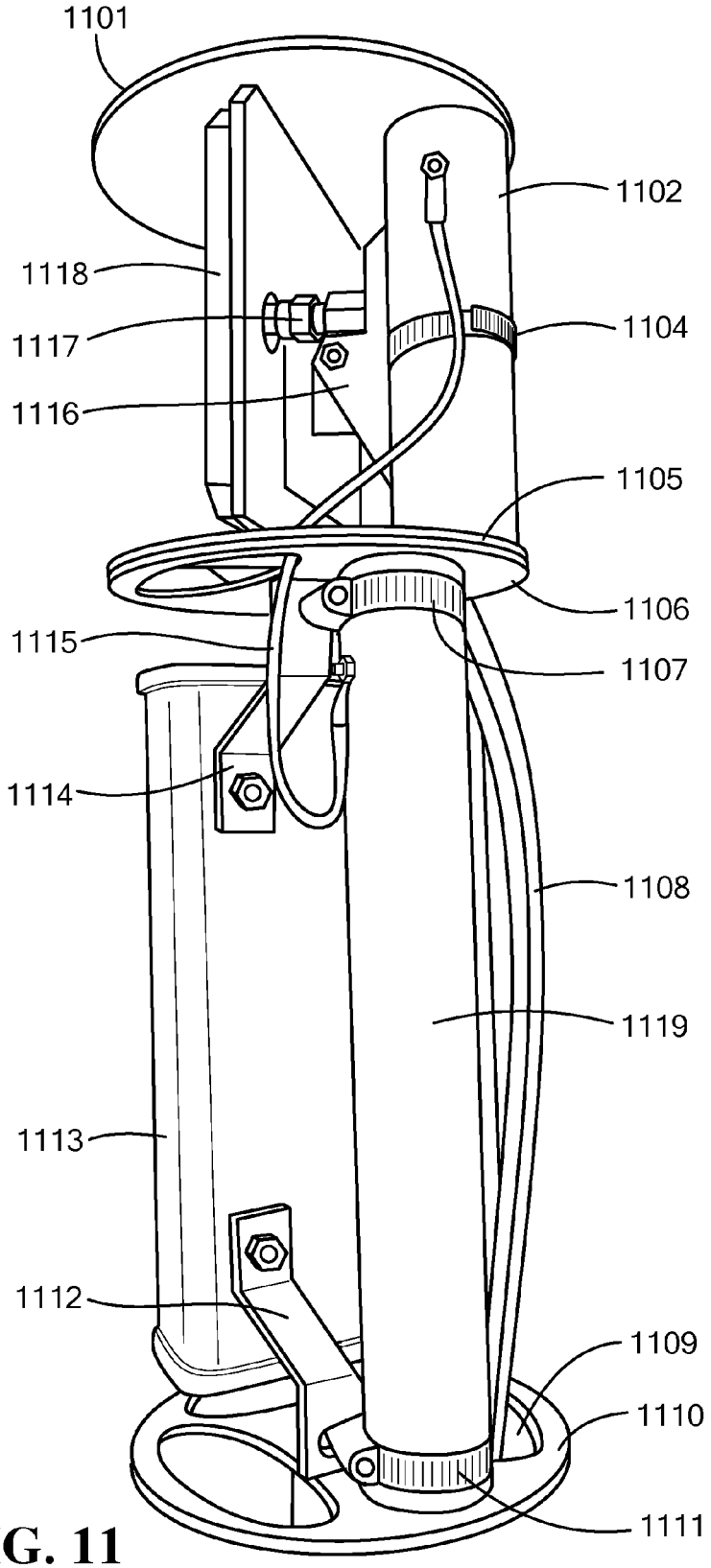
FIG. 11 is a side schematic drawing of a radio mast, in accordance with some embodiments.

FIG. 11 is a side schematic drawing of a radio mast, in accordance with some embodiments. Plate 1101 is a top plate of a first radio antenna module, which also includes perpendicular attachment pole 1102, bottom plate 1105, and antenna 1118. Antenna 1118 is mounted to attachment pole 1102 via mount 1116, which is capable of being angled up and down and which is attached to attachment pole 1103 via a band clamp or hose clamp 1104. Antenna 1118 has RF input 1117, which is fed by RF cable 1108, which passes behind attachment pole 1102, through holes in the plates below, including hole 1109, to a radio (not shown).

Bottom plate 1105 is attached to top plate 1106 of a second antenna module using a bolt and nut assembly (not shown). The second antenna module is significantly taller than the first antenna module to accommodate its larger antenna, and is made up of top plate 1106, attachment pole 1119, antenna 1113, and bottom plate 1110. Antenna 1113, which may be a 3G or 4G antenna, is attached to attachment pole 1119 by mounting brackets 1112 and 1114, which are affixed to the antenna with nuts and bolts and which are attached to attachment pole 1119 by band clamps/hose clamps 1107 and 1111. Different mounting brackets may be used to obtain angle tilt capability. Grounding wire 1115 serves to electrically connect attachment poles 1102 and 1119, in case there is insufficient conductivity between the plates via the center axis bolt.

Figure 12:
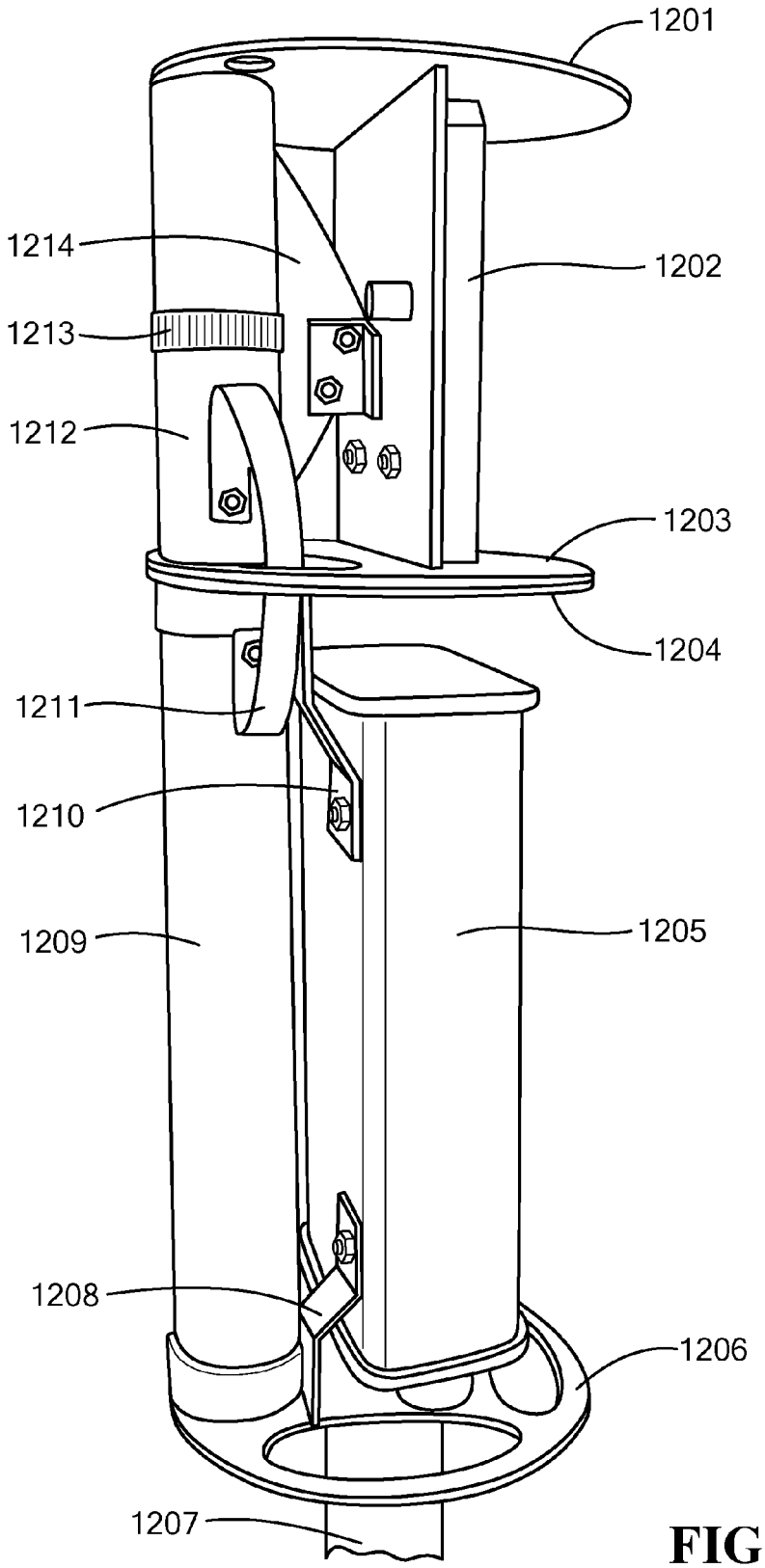
FIG. 12 is a second side schematic drawing of a radio mast, in accordance with some embodiments.

FIG. 12 is a second side schematic drawing of a radio mast, in accordance with some embodiments. Visible in FIG. 12 are top plate 1201, attachment pole 1212, and bottom plate 1203 of a first antenna module, and antenna 1202 within, connected to attachment pole 1212 via adjustable bracket 1214 and band clamp 1213. Attachment pole 1212 is welded to the top and bottom plates. Conductive braided ground strap 1211 couples attachment pole 1212 and attachment pole 1209, which are otherwise only electrically connected through the center axis bolt.

Bottom plate 1203 of the first antenna module is coupled via the center axis bolt to a second antenna module, which includes top plate 1204, attachment pole 1209, bottom plate 1206, and antenna 1205. Attachment pole 1209 is welded to the top and bottom plates. The center axis bolt permits the connection between the antenna modules to be loosened, the modules to be rotated with respect to each other, and then re-tightened. Antenna 1205 is coupled to attachment pole 1209 via mounting brackets 1208 and 1210, which as shown do not permit angle adjustment.

Mast/pole 1207 is shown connected to bottom plate 1206, and may be the mast or pole upon which the antenna assembly is to be mounted, or may be a mount point for connecting the antenna assembly to a building or tower.

Figure 13:
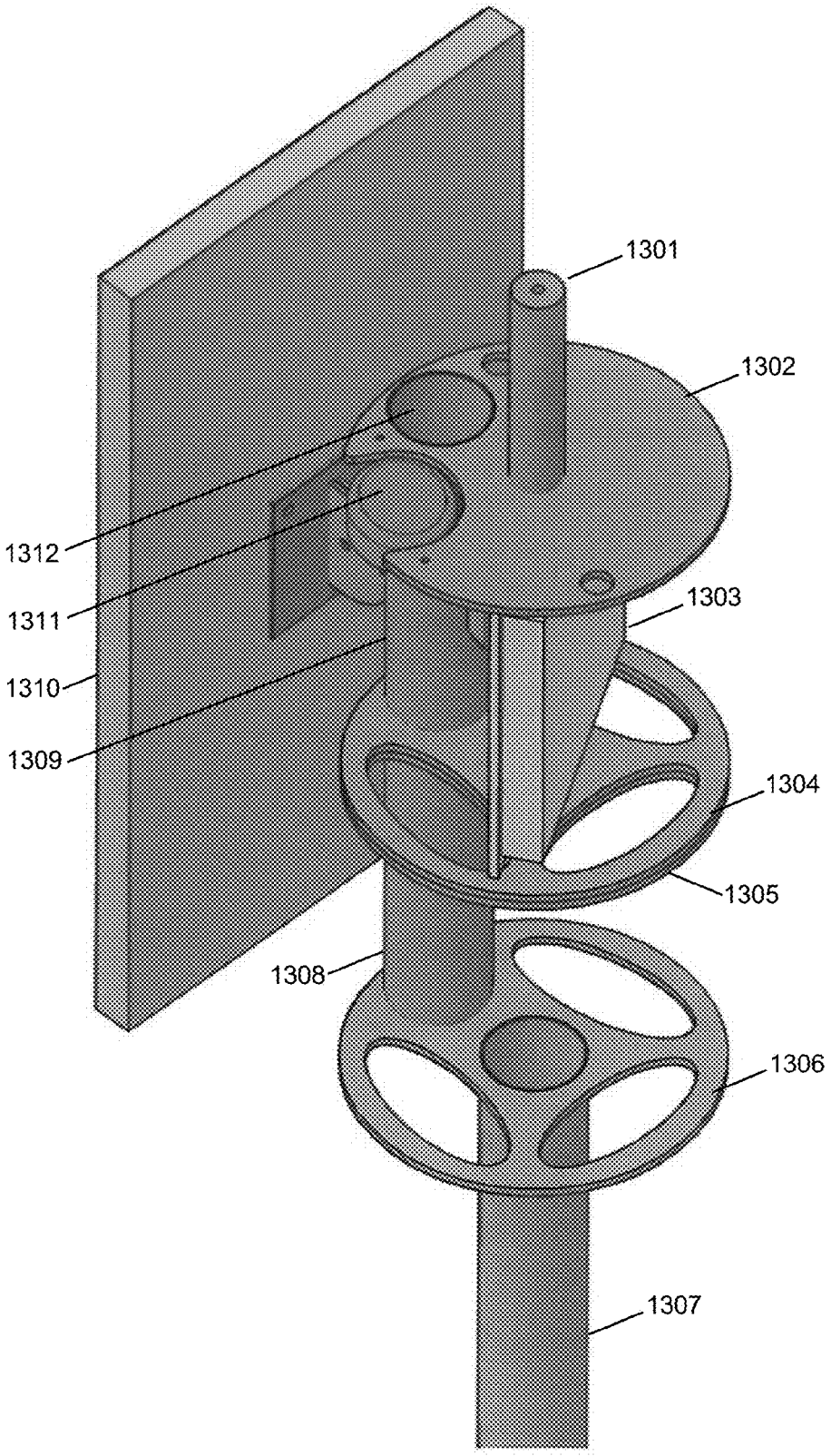
FIG. 13 is a schematic drawing of a radio mast with panel antenna, in accordance with some embodiments.

FIG. 13 is a schematic drawing of a radio mast with panel antenna, in accordance with some embodiments. Top mounting pole 1301 protrudes from top plate 1302. A first antenna module includes top plate 1302, attachment pole 1309, antenna 1303 (which is attached to attachment pole 1309), and bottom plate 1304. A second antenna module includes top plate 1306, attachment pole 1308, and bottom plate 1306. Mast/pole 1307 is shown connected to bottom plate 1306, and may be the mast or pole upon which the antenna assembly is to be mounted, or may be a mount point for connecting the antenna assembly to a building or tower.

Notably, a high-gain panel antenna 1310 is also provided. This panel antenna is too large to fit within the cylindrical volume of the stacked antenna assembly. It is instead mounted to the side of the antenna stack. FIG. 13 shows this schematically without a radome. Mount point 1311 fits into a cylindrical or circular gap in top plate 1302, and may be a cylindrical hinge permitting adjustable rotation of the panel antenna. In some cases, mount point 1311 itself may be connected to top plate 1302 by two secondary brackets, which are attached with screws. As shown, mount point 1311 is attached to a bracket that does not permit angling the panel antenna up or down, but such a bracket could be provided in some embodiments. Mount point 1311 is next to, but not in the same position as, the egress of attachment pole 1309 where it meets top plate 1302, which is shown as hollow cavity 1312.

Figure 14:
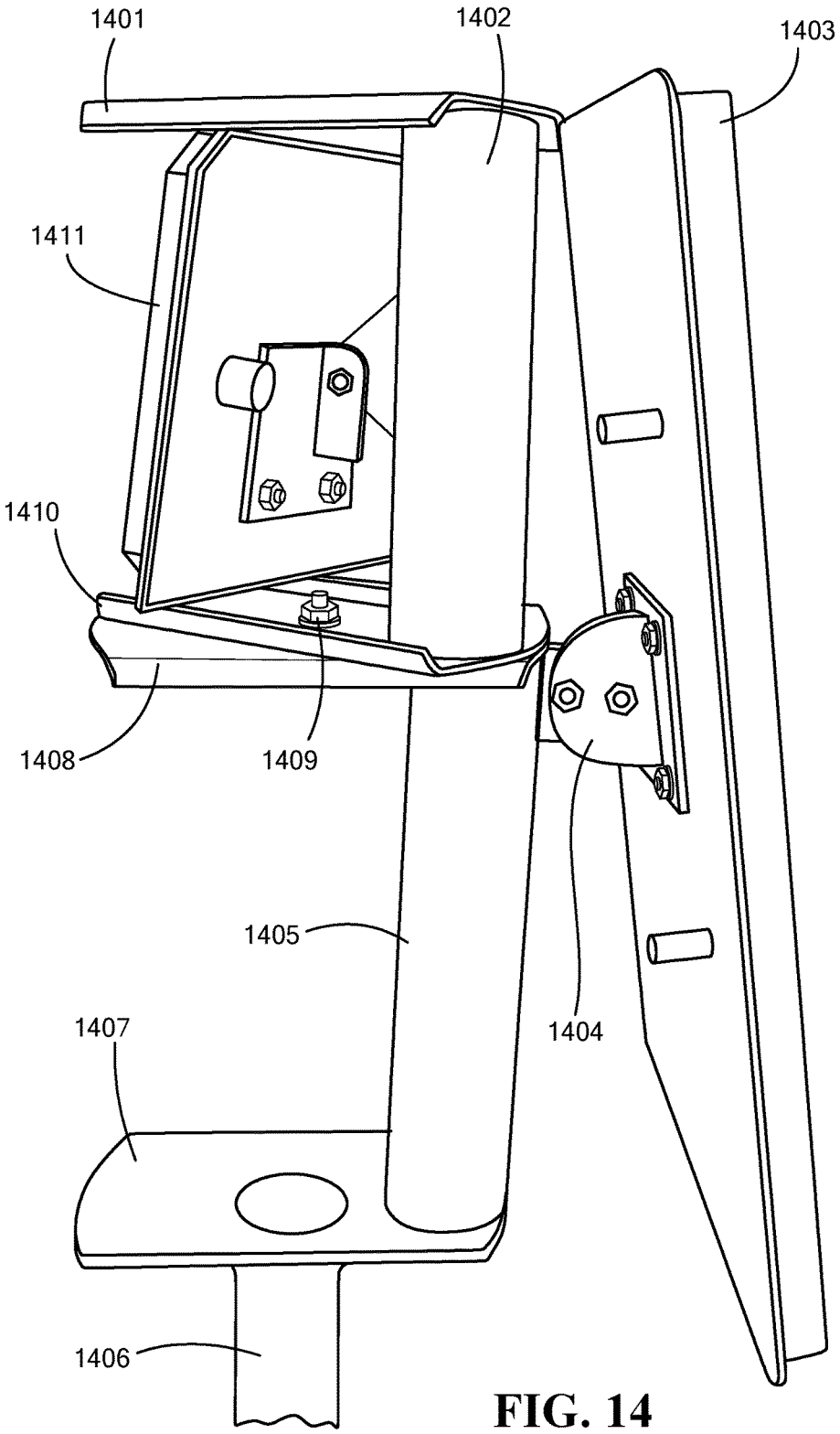
FIG. 14 is a further schematic drawing of a radio mast with panel antenna, in accordance with some embodiments.

FIG. 14 is a further schematic drawing of a radio mast with panel antenna, in accordance with some embodiments. Whereas several of the embodiments described above have been shown using tubular attachment points and flat plates, here sections of a U-channel utility molding have been cut to form smaller top and bottom plates. Top plate 1401, attachment pole 1402, and bottom plate 1410 are part of a first antenna module, and include antenna 1411. A second antenna module, not filled by an antenna, is shown below it, with top plate 1408, attachment pole 1405, and bottom plate 1407. Bottom plate 1407 is attached by welding to hollow tube 1406, which may be a mast or an attachment point. The bolt and nut assembly 1409 that fastens the two antenna modules together in an adjustably rotatable fashion is clearly shown. High-gain panel antenna 1403 is also shown mounted to the rear of attachment pole 1405, using mounting bracket 1404, in a fashion different than that shown in FIG. 13, namely, in that antenna 1403 is attached to the rear of one of the attachment poles and not to a separate mount point.

Figure 15:
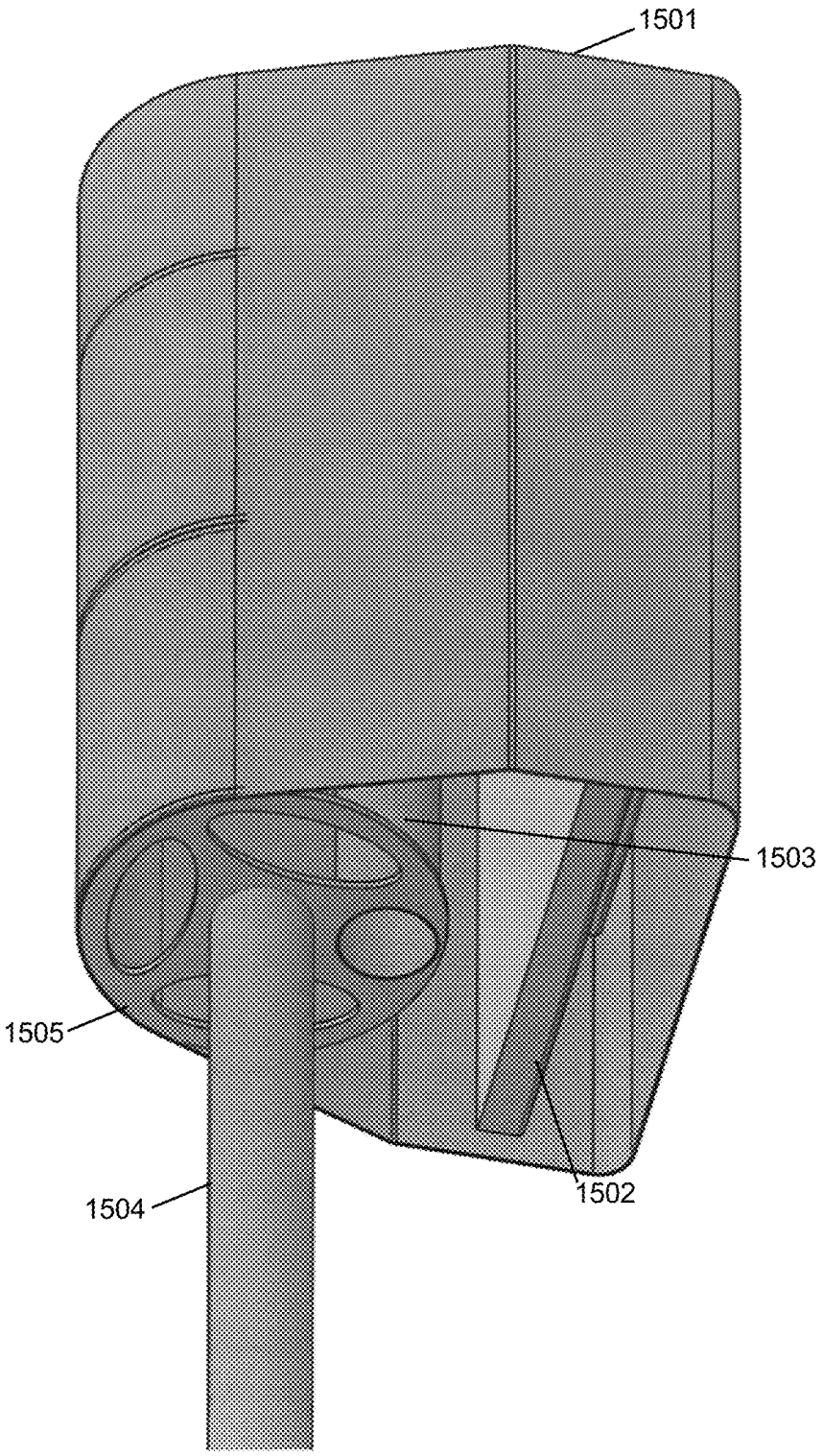
FIG. 15 is a schematic drawing of a radio mast with panel antenna and attached radome, in accordance with some embodiments.

FIG. 15 is a schematic drawing of a radio mast with panel antenna and attached radome, in accordance with some embodiments. In the case that a large panel antenna is attached, it may be necessary to provide a differently-shaped radome. However, the goals of having a single radome that cover all antennas can still be met. Radome 1501 is cylindrical on one side and flat on another side to accommodate a cylindrical antenna stack on the left side and high-gain panel antenna 1502 on the right side. Attachment pole 1503 and bottom plate 1505 are visible through the cutaway bottom of the radome. Bottom plate 1505 is attached by welding to hollow tube 1504, which may be a mast or an attachment point.

Unless otherwise mentioned, the antennas described herein may be mesh antennas, 3G, 4G, or other types of antennas. Unless indicated as being omnidirectional antennas, the antennas described herein may be directional in nature. Different geometries for the top and bottom plates, such as triangular, hexagonal, square, or other shapes, could be contemplated and radomes covering the resultant triangular, hexagonal, square, or other-shaped prismatic volume are contemplated. Additional holes for cable routing, the use of screws, bolts, or nuts to fasten objects together, the use of motors to enable remote operation, and the like are also contemplated as alternatives to the the description herein. In some embodiments, these fasteners and other structural components may be selected to reduce passive intermodulation (PIM).

In some embodiments, an arbitrary number of antennas may be stacked, each with its own setback/non-centered attachment pole and mounting plate. The GPS antenna may be placed at the top.

In some embodiments, one or more omnidirectional antennas may be placed at the top of an antenna stack, as described herein. Multiple omnidirectional antennas may be placed at the top, in conjunction with a GPS antenna, in some embodiments. It is understood that the use of omnidirectional antennas with different frequency bands offers less interference. The location of omnidirectional antennas at the top of the antenna stack (i.e., not enclosing these antennas within a setback) provides advantages for signal reception. Omnidirectional antennas may also be placed at the bottom of the stack equivalently to placing them at the top of the stack. Omnidirectional antennas may protrude from the radome, or be hidden by the radome.

In some embodiments, the entire antenna assembly may be mounted using mounting clamps. The mounting clamps may be provided either at the top or bottom of the assembly. Two mounting clamps may be provided at either the top or the bottom to support the weight of the antenna.

Poles, struts, structures, clamps, and fixtures may be made of steel, or aluminum, or of another material. Hose clamps, pipe mount clamps, standoffs, banding clamps, chain mounts, shrink tubing, plastic or metal ties, or other fasteners may be used where appropriate herein.

Further details are provided in the attached figures.

Although the present disclosure has been described and illustrated in the foregoing example embodiments, it is understood that the present disclosure has been made only by way of example, that the various characteristics described above of the various embodiments may be combined in different fashion than described above, and that numerous changes in the details of implementation of the disclosure may be made without departing from the spirit and scope of the disclosure.

The invention claimed is:

1. A mount for a plurality of radio antennas, comprising:

a plurality of stacked radio antenna mounting assemblies, each further comprising:

a top mounting plate;

a mounting pole affixed to a bottom face of the top mounting plate; and a bottom mounting plate affixed at a top face to the mounting pole, and rotatably affixed to a top mounting plate of an adjoining mounting assembly, wherein the mounting pole is affixed to the top mounting plate and the bottom mounting plate at an edge of the top mounting plate and at an edge of the bottom mounting plate aligned with the edge of the top mounting plate so as to create a cylindrical volume, and wherein each radio antenna mounting assembly is thereby configured to be independently rotatable in azimuth with respect to said adjoining mounting assembly; and a radio-transparent radome with a height greater than a combined height of each of the plurality of radio antenna mounting assemblies, the radio-transparent radome configured to slide over the plurality of radio antenna mounting assemblies to cover each of the cylindrical volumes of the plurality of radio antenna mounting assemblies.

2. The mount of claim 1, wherein the plurality of radio antenna mounting assemblies are each rotatably affixed to said top mounting plate of said adjoining mounting assembly using a bolt and a nut threaded mating assembly.

3. The mount of claim 1, further comprising a setback comprising a distance between matching edges of the top and bottom mounting plates and the mounting pole of each of the plurality of radio antenna mounting assemblies, the setback configured to enable tilt angle adjustment of antennas coupled to the mounting pole within the cylindrical volume of the each radio antenna mounting assembly.

4. The mount of claim 1, further comprising a mounting bracket with screw holes for mounting a radio frequency antenna, the mounting bracket coupled to the mounting pole of each of the plurality of radio antenna mounting assemblies, the mounting bracket configured to permit tilt angle adjustment of said radio frequency antenna mounted within the cylindrical volume independent of an angle of any other antenna in the plurality of radio antenna mounting assemblies.

5. The mount of claim 1, further comprising a mounting bracket configured to permit tilt angle adjustment of a radio frequency antenna mounted within the cylindrical volume, and a tilt angle adjustment angle guide colocated with the mounting bracket.

6. The mount of claim 1, further comprising a rotatable mounting point adjacent to the mounting pole and coupled to the top mounting plate or the bottom mounting plate of said mounting assembly.

7. The mount of claim 6, wherein said rotatable mounting point is configured to permit azimuth rotation of an antenna mounted outside of the cylindrical volume.

8. The mount of claim 1, wherein the top and the bottom mounting plates further comprise a plurality of cutouts for threading radio frequency cables.

9. The mount of claim 1, further comprising an angle guide between the bottom mounting plate and the top mounting plate of the adjoining mounting assembly having marks to aid in adjusting the orientation of the mounting assembly and the adjoining mounting assembly, and a cutout in the bottom mounting plate and the top mounting plate of the adjoining mounting assembly showing a visible portion of the angle guide.

10. The mount of claim 1, further comprising a grounding wire passing through holes in adjoining top and bottom mounting plates for providing grounding of antennas in separate mounting assembly volumes.

11. The mount of claim 1, wherein the radio-transparent radome is cylindrical on one side and flat on another side so as to slide over the plurality of radio antenna mounting assemblies and also over a panel antenna attached to a side of a radio antenna mounting assembly exterior to an internal volume of the radio mounting assembly.

12. The mount of claim 1, wherein each radio antenna mounting assembly is configured to be independently rotatable without any portion of any antenna mounted within each radio antenna mounting assembly protruding outside of a cylindrical volume of the each radio antenna mounting assembly.

13. The mount of claim 1, further comprising a motor for rotating an azimuth angle of said radio antenna mounting assembly.

14. The mount of claim 1, further comprising a motor for rotating a tilt angle of a radio antenna at a setback mounted within said radio antenna mounting assembly.

15. The mount of claim 1, further comprising a topmost plate, the topmost plate being rotatably attached to said top plate of said radio antenna mounting assembly, the topmost plate further comprising mount points for a global positioning system (GPS) antenna and an omni-directional antenna.

16. The mount of claim 1, wherein the plurality of radio antenna mounting assemblies share a circumference but have differing cylindrical volumes and differing heights.

17. The mount of claim 1, wherein said mounting pole is hollow and used for radio frequency cable routing.

18. The mount of claim 1, further comprising a 3G antenna, a Long Term Evolution (LTE) antenna, and a global positioning system (GPS) antenna.

19. The mount of claim 1, further comprising a plurality of Long Term Evolution (LTE) antennas.

* * * * *